US005718419A

United States Patent [19]

Hall

[11] Patent Number: 5,718,419

[45] Date of Patent: Feb. 17, 1998

[54] WORKPIECE POSITIONING ADAPTER FOR PLIERS SUCH AS TOGGLE CLAMPS

[76] Inventor: Robert M. Hall, 3905 Suffolk Cir., Lexington, Ky. 40515

[21] Appl. No.: 439,427

[22] Filed: May 11, 1995

[51] Int. Cl.[6] ..... B25B 1/00

[52] U.S. Cl. ..... 269/6; 269/37; 269/41; 269/228; 269/282

[58] Field of Search ..... 269/3, 6, 41, 282, 269/228, 37, 902

[56] References Cited

U.S. PATENT DOCUMENTS

| | | | |
|---|---|---|---|
| 4,033,570 | 7/1977 | Curlow | 269/41 |
| 4,061,321 | 12/1977 | Farr | 269/41 |
| 4,725,049 | 2/1988 | Cantarinhas | 269/6 |
| 4,805,315 | 2/1989 | Nesbitt | 269/41 |
| 5,064,178 | 11/1991 | Nimtz | 269/41 |
| 5,482,263 | 1/1996 | Kutzleb | 269/41 |

*Primary Examiner*—Robert C. Watson
*Attorney, Agent, or Firm*—Maurice L. Miller, Jr.

[57] ABSTRACT

An adapter plate for removable attachment to a U-shaped lower jaw of a set of toggle clamps is disclosed. The adapter plate is constructed of a rigid metal suitable for providing a backing for a joint to be welded by means of a MIG welding or arc welding process such as copper or brass. The plate is triangularly shaped and includes upper and lower broad flat surfaces, a base side and a pair of adjacent sides extending from opposite ends of the base side and intersecting at a predetermined angle to form an apex. The plate contains beveled edges for clearing the rounded inside cornters of a pair of angle iron workpieces when said workpieces are placed against one or more sides of the plate to be positioned relative to one another for being held by the clamps for welding the workpieces together or for other purposes. The plate can be used to position the workpieces in the clamps against the adjacent sides at the predetermined angle relative to one another, such as a right angle, or it can be used to position the workpieces against the base side in a straight end-to-end alignment relative to one another. A weld joint backing walls for attachment to the plate for welding two angle irons together are also disclosed.

7 Claims, 3 Drawing Sheets

WORKPIECE POSITIONING ADAPTER FOR PLIERS SUCH AS TOGGLE CLAMPS

BACKGROUND OF THE INVENTION

This invention relates generally to an adapter plate for mounting in a pair of pliers for precisely positioning a pair of workpieces relative to one another to be held by the pliers for welding the workpieces together and/or for other purposes. More specifically, this invention relates to a triangularly shaped adapter plate for removable mounting in a set of pliers or clamps for precisely positioning a pair of workpieces in the pliers or clamps relative to one another in either of two different alignments.

Welders often use a conventional set of pliers of the type shown as toggle clamps to firmly hold two metal workpieces in fixed positions relative to one another for welding the workpieces together in a desired alignment. It is often necessary to use such clamps to hold two angle iron members or flat bars at right angles relative to one another for welding a properly prepared miter joint between them to form an L-shaped assembly or one corner of a rectangular frame. In the case of a closed rectangular frame, four flat bars or angle irons will be arranged in a rectangle with opposing ends properly mitered, after which opposing corner portions of the frame members will be securely gripped and held in a right angle alignment using four of such clamps. The mitered joints are then welded together while the adjacent workpieces are held with clamps. However, it is very difficult to obtain and secure a precise right angle alignment between adjacent members of a frame. Failure to obtain four precise right angle corners in a rectangular frame upon welding of the corner joints can result in deformations and stresses in the frame.

I have performed a preliminary patent search and have not found nor am I otherwise aware of any prior art adapter for use in pliers, such as toggle clamps, which will serve to guide the precise positioning of two workpieces in the clamps so that they can be firmly held at a precise right angle, or any other angle for that matter, relative to one another for being welded together or for other purposes. By means of my invention, I provide such an adapter which can also be used to align two workpieces in a precise straight end-to-end alignment for welding the two workpieces together. My invention thus substantially overcomes these and other difficulties encountered in the prior art when precisely arranging and positioning metal workpieces relative to one another in a set of conventional pliers or clamps.

SUMMARY OF THE INVENTION

It is an object of my invention to provide a workpiece positioning adapter plate for attachment to a jaw of a set of pliers or clamps to permit the precise positioning of a pair of workpieces in the set for being held by the set at precise positions relative to one another for welding the workpieces together or for performing other operations on the workpieces.

It is a further object of my invention to provide such a workpiece positioning adapter which has the capability of positioning two workpieces in a set of clamps at either a predetermined angle relative to one another or in straight end-to-end alignment relative to one another as desired.

It is also an object of my invention to provide a workpiece positioning adapter for attachment to a set of pliers or clamps which also provides a suitable backing for a joint to be welded between two workpieces held in the set using either a MIG welding process or an arc welding process.

It is yet another object of my invention to provide a workpiece positioning adapter for attachment to a set of pliers or clamps which is capable of precisely positioning a pair of angle iron workpieces in the set.

Briefly, in accordance with my invention, there is provided a workpiece positioning adapter for a set of clamps of the type used for holding a pair of metal workpieces for welding the workpieces together. The adapter comprises a rigid triangularly shaped plate. The plate includes upper and lower broad flat surfaces, a base side and a pair of adjacent sides. The adjacent sides extend from opposite ends of the base side and intersect with one another at a predetermined angle to form an apex. The adapter also comprises a first means for mounting the plate between the jaws of a set of clamps of the type used for releasably gripping a pair of workpieces such that the workpieces can be positioned along the adjacent sides and held by the clamps at the predetermined angle relative to one another.

These and other objects, features and advantages of my invention will be come apparent to those skilled in the art from the following detailed description and attached drawings, upon which, by way of example, only a preferred embodiment of my invention is illustrated.

DESCRIPTION OF THE PREFERRED EMBODIMENT

Figure 1:
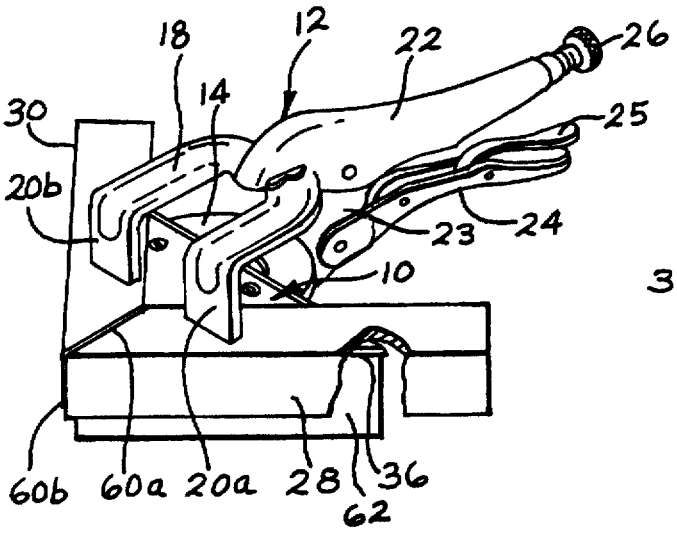
FIG. 1 shows a perspective view of a conventional set of welder's toggle clamps, a novel adapter plate mounted in the clamp, and a pair of angle iron members held in the clamp against adjacent edges of the adapter plate at a precise right angle relative to one another, thus illustrating a preferred embodiment of my invention.

Referring now to the drawing figures there is shown, in a preferred embodiment of my invention, a novel workpiece positioning adapter plate generally designated 10, for use with a conventional set of welder's pliers of the type known as toggle clamps, generally designated 12.

The toggle clamps 12 includes a U-shaped lower jaw 14 having a pair of parallel, spaced apart arms 16*a* and 16*b* which essentially lie in a single plane. See particularly FIGS. 4–5 and 9. The clamps 12 also includes an upper jaw 18 having a U-shaped portion which generally conforms in size and shape to the lower jaw 14. A pair of gripping fingers 20*a* and 20*b* extend perpendicularly from the ends of the arms of the U-shaped portion toward end portions of the arms 16*a* and 16*b*, respectively, of the lower jaw 14. The base of the U-shaped portion of the upper jaw 18 is fixedly connected to an upper handle 22. The base of the lower jaw 14 is fixedly connected to a rocker element 23 which is, in turn, pivotally connected to both the upper arm 22 and a lower arm 24. Accordingly, the lower jaw 14 is pivotally movable relative to the fingers 20*a* and 20*b* of the upper jaw 18 between an open and a closed position with movement of the lower handle 24 relative to the upper handle 22. The position of the lower handle 24 can be locked relative to the upper handle 22 by means of a lever 25 to lock a workpiece between the lower jaw 14 and the fingers 20*a* and 20*b* of the upper jaw 18. An adjustment screw 26 permits locking of the lower jaw 14 relative to the fingers 20*a* and 20*b* at various spaced apart positions to permit locking of the clamps 12 to workpieces of different thicknesses.

The plate 10 may also be used as a backing for a joint to be welded between two workpieces, such as a pair of angle iron members 28 and 30 held in the clamps 12 when using either a MIG welding process, an are welding process or any other type of welding process wherein the weld material will not stick to brass or copper. The plate 10 comprises a relatively flat triangularly shaped part constructed of either copper, brass or other metal or metal alloy to which weld material will not stick during a MIG or are welding operation. In the present example, the plate 10 is constructed in the shape of a right triangle such that it has two relatively broad, flat surfaces, and three relatively thin sides, including a base side 32 and two equal length adjacent sides 34 and 36, which adjacent sides meet to form an apex 38 at an angle of 90 degrees.

The plate 10 of the present example can therefore be used to position the two members 28 and 30 in the jaws 14 and 18 of the set 12 at either a right angle relative to one another or in a straight end-to-end alignment, depending upon how the plate 10 is mounted in the clamps 12. In order to use the plate 10 in both of these alignment modes it is necessary that it be removably attachable to the lower jaw 14. To accomplish this, a slight modification of the lower jaw 14 may be necessary. In the present case, I weld or otherwise attach a flat steel bar 40 between end portions of the arms 16*a* and 16*b*. See FIGS. 4–5 and 9. Inwardly of both ends of the bar 40, a pair of machine screw holes 42 is drilled and tapped therethrough. In registry with these tapped holes 42 in the bar 40, a pair of enlarged untapped holes 44 is drilled through the arms 16*a* and 16*b*.

For the arrangement of the plate 10 as shown in FIGS. 1 and 3–5, a first pair of enlarged untapped holes 46 is drilled through the plate 10 near the base side 32 which are spaced apart along the base so as to register with the tapped holes 42 of the bar 40 and the enlarged untapped holes 44 of the arms 16*a* and 16*b*. See also FIG. 2. The holes 46 are countersunk as at 48 where they open onto an upper broad surface 50 of the plate 10. The plate 10 is then mounted on the jaw 14 and secured thereto with suitable threaded fasteners 51 which are inserted head up, first, into and through the countersunk openings 48 of the holes 46, thence threaded through the tapped holes 42 of the bar 40 and, finally inserted into the untapped holes 44 in the legs 16*a* and 16*b*. Since the material from which the plate 10 is made is a relatively soft brass or copper, the defining surfaces of the holes 46 are not suitable for being threaded to secure the fasteners 51 thereto as such threading would not be durable. Moreover, since the arms 16*a* and 16*b* will usually be made of a case hardened steel, the defining surfaces of the holes 44 formed therethrough would be extremely difficult to tap for securing the screws 51 therein. Therefore, the bar 40 should be made of a suitable soft steel wherein the defining surfaces of the holes 42 can be readily tapped to provide durable threads for securing the screws 51 therein.

Figure 7:
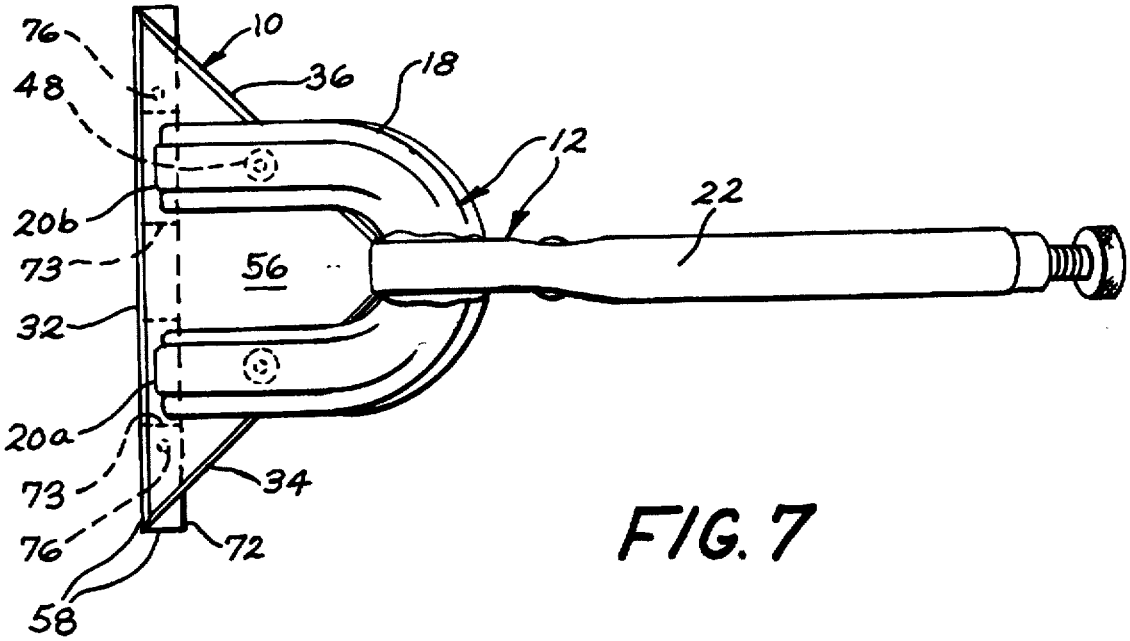
FIG. 7 shows a top plan view of the clamps of FIGS. 1 and 3–5 and the adapter plate of FIGS. 1–5 except that, in this view, the plate has been removed from the clamp, turned over and remounted for precisely aligning a pair of angle iron members in a straight end-to-end relationship.
Figure 8:
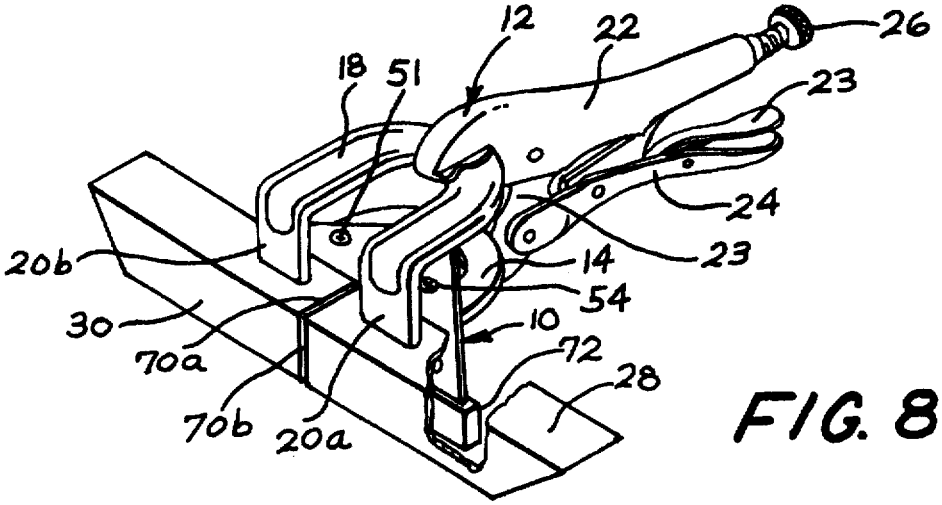
FIG. 8 shows a perspective view of the clamps of FIGS. 1, 3–5 and 7 and the adapter plate of FIGS. 1–5 and 7 attached to the clamps, the same as in FIG. 7, with the clamps holding a pair of angle iron members against the adapter plate in a straight end-to-end relationship.
Figure 9:
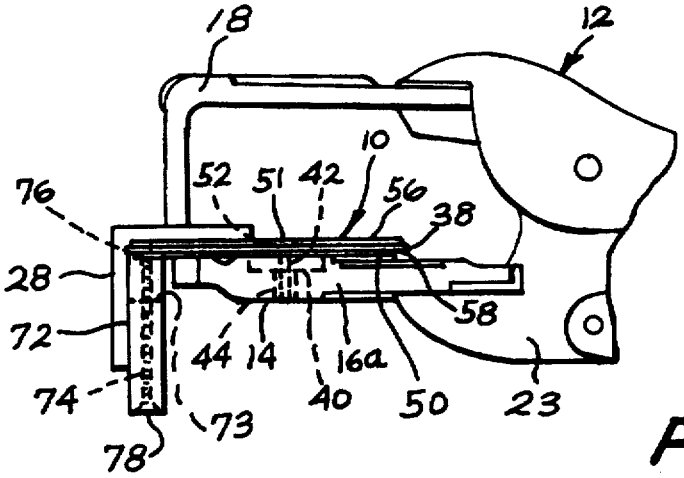
FIG. 9 shows a side elevation view of a fragment of the clamps of FIGS. 1, 3–5 and 7–8, the adapter plate of FIGS. 1–5 and 7–8 arranged as in FIGS. 7–8, and an angle iron member as in FIG. 8.

For the arrangement of the plate 10 as shown in FIGS. 7–9, a second pair of enlarged untapped holes 52, which are equally spaced apart relative to the holes 46 and which are located near the adjacent sides 34 and 36, are drilled through the plate 10 so as to be registrable with the holes 42 and 44. The holes 52 are then countersunk as at 54 where they open onto a lower broad surface 56 of the plate 10. As shown best in FIG. 9, the plate 10 is then mounted on the jaw 14 with the broad side 56 up and secured thereto with the threaded fasteners 51 which are inserted head up, first, through the countersunk untapped holes 52, thence threaded through the tapped holes 42 of the bar 40 and, finally, are inserted into the untapped holes 44 of the legs 16*a* and 16*b*.

Where the angle iron members 28 and 30 are formed from soft steel plate by bending the sides thereof until they are perpendicular to one another, as is usually the case, the resulting elongated inside corners of the members 28 and 30 will be slightly rounded on a small but definite radius. Such rounded corners can interfere with the precise alignment of the flat sides of the members 28 and 30 along and against the sides 32, 34 and 36 of the plate 10. To avoid this possibility, I prefer to bevel the elongated edges of the plate 10 between the broad surfaces 50 and 56, on the one hand, and the flat sides 32, 34 and 36 on the other hand, in order for the edges to clear the rounded corners of the members 28 and 30 when one or more of those sides is placed flush against one or more of the sides of the plate 10. The beveled edges of the plate 10 are shown in various drawing figures at 58.

In the plate and clamps arrangement shown in FIGS. 1 and 3–5, the plate 10 is mounted on the jaw 14 with the apex 38 projecting forwardly of the jaws 14 and 18 and pointing away from the handles 22 and 24. This arrangement is used to position the members 28 and 30 precisely perpendicular to one another along and against the adjacent sides 34 and 36, respectively, so that the clamps 12 can secure the members in that position for welding them together along a first side seam 60*a* of a miter joint. While the first side seam 60*a* is being welded, the broad surface 50 forms a backing to restrain the weld material from leaking out of the seam while molten and before the weld material has solidified. In some cases, in order to properly finish welding the joint, a second side seam 60*b* must also be welded, which must also be fully backed so as to prevent molten weld material from leaking therethrough.

Figure 2:
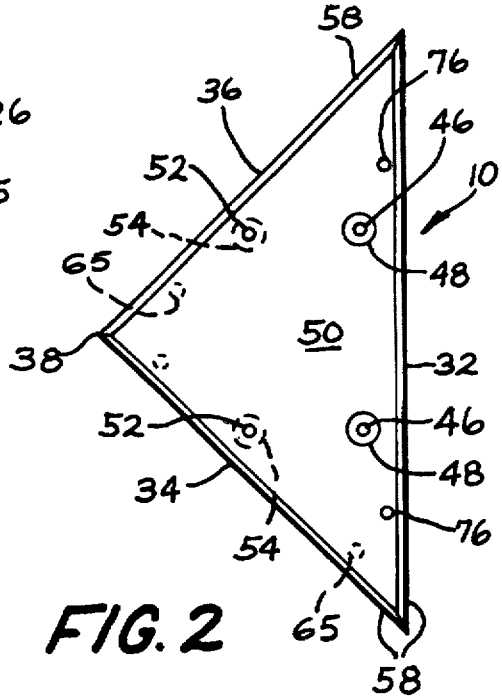
FIG. 2 shows a plan view of the adapter plate of FIG. 1.
Figure 3:
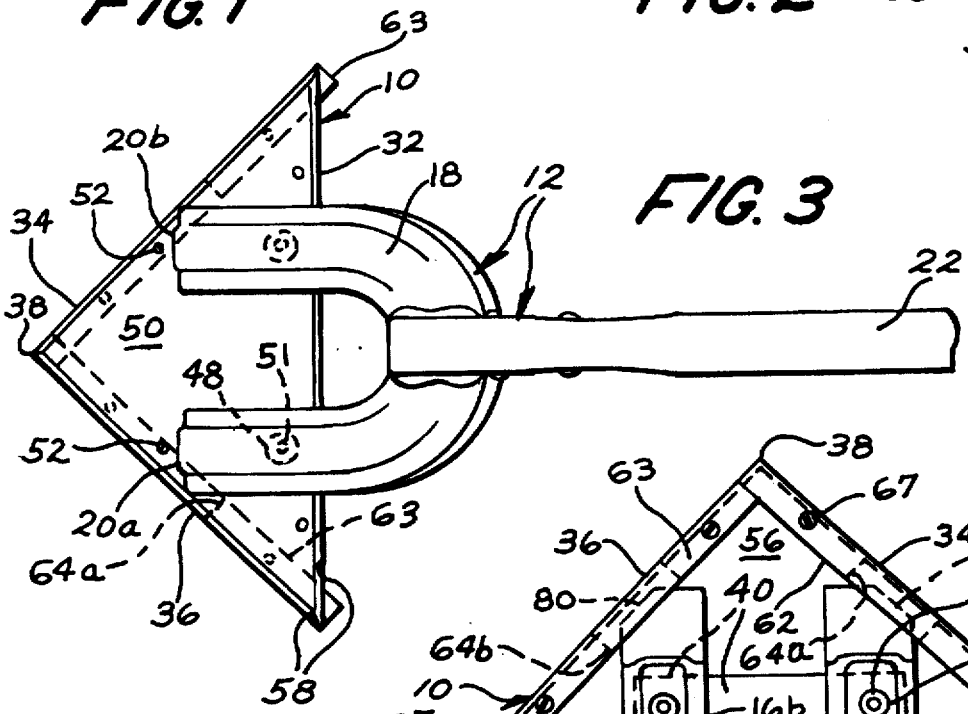
FIG. 3 shows a top plan view of the clamps and adapter plate of FIG. 1, the adapter, plate also being the same as shown in FIG. 2.
Figure 4:
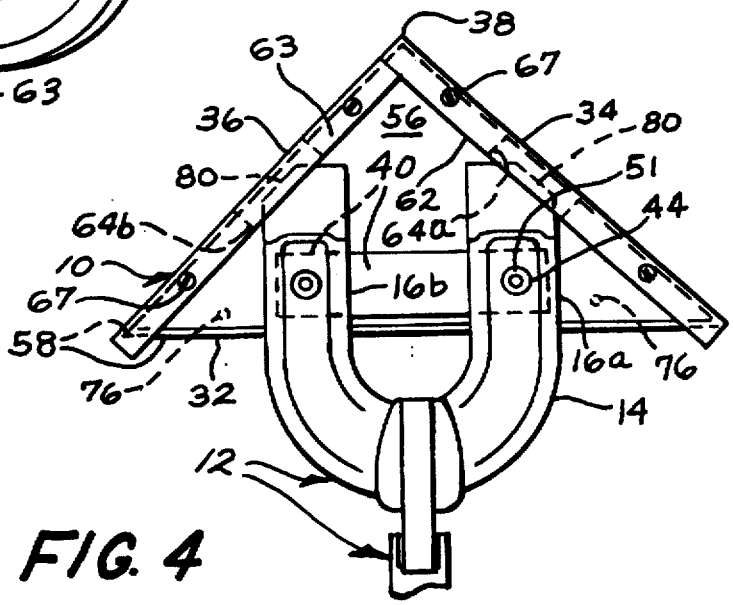
FIG. 4 shows a bottom plan view of a portion of the clamps of FIGS. 1 and 3 and the adapter plate of FIGS. 1–3.
Figure 5:
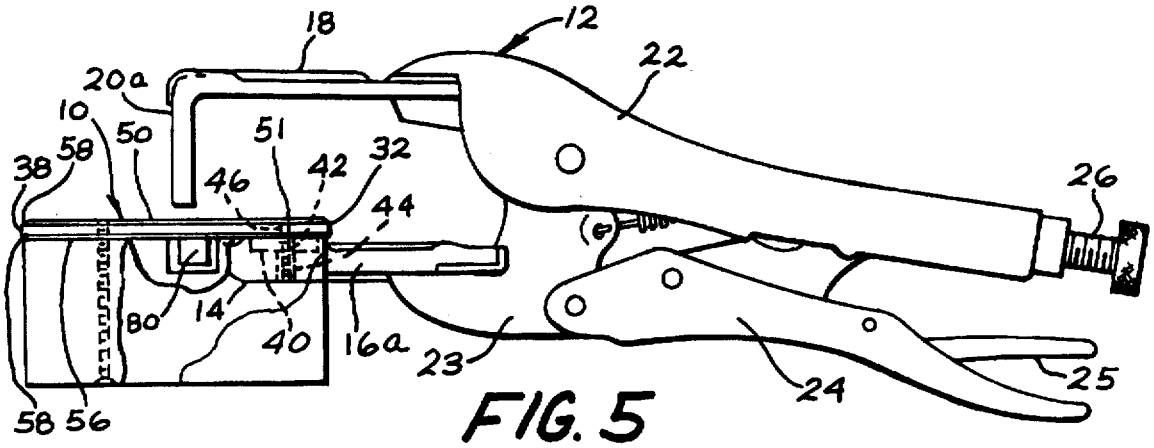
FIG. 5 shows a side elevation view of the clamps of FIGS. 1 and 3–4 and the adapter plate of FIGS. 1–4.
Figure 6:
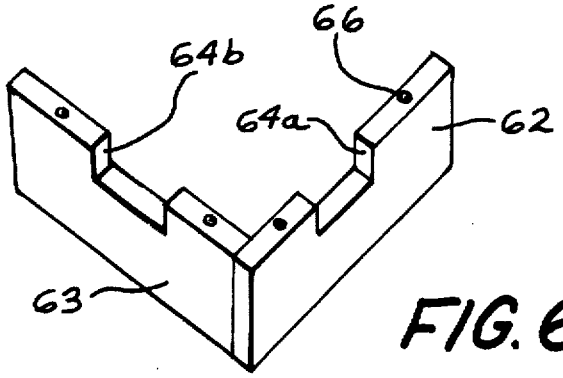
FIG. 6 shows a perspective view of a pair of weld joint backing walls, the same as attached to the plate when arranged as shown in FIGS. 1 and 3–5.

To accomplish this, a pair of weld joint backing bars 62 and 63 are provided, as shown best in FIG. 6, which are removably attached to the plate 10 as shown in FIGS. 1 and 3–5. Specifically, the bars 62 and 63 are arranged so as to attach to the underside 56 of the plate 10 and extend along the adjacent sides 34 and 36, respectively, Each of the bars 62 and 63 contain a single upwardly opening slot 64*a* and 64*b*, respectively, into which distal ends of the arms 16*a* and 16*b* project as best shown in FIG. 4. Blind tapped holes 65 are formed in the plate 10 so as to open onto the underside surface 56 in registry with untapped holes 66 formed through the bars 62 and 63. A pair of suitable threaded fasteners 67 are inserted upwardly through the holes 66 and threadably inserted into the blind holes 65 to secure the bars 62 and 63 to the plate 10. A base portion of the holes 66 may be countersunk to accommodate the heads of the fasteners 67 as shown in FIG. 5. In this manner, the bars 62 and 63 can be used to provide a suitable backing for welding the seam **60*b*. It will be appreciated that the height of the bars 62 and 63 should be such that a backing is provided for the entire length of the seam 60*b* to be welded. It is also important that the outwardly facing vertical sides of the bars 62 and 63 be closely aligned with the vertical sides 34 and 36 of the plate 10 so that the angle irons 28 and 30 rest flush against both surfaces when arranged as shown in FIG. 1**.

The plate 10 can also be used to position a pair of flat workpiece bars having properly mitered opposing ends at a right angle within the clamps 12 for welding the flat bars together or for other purposes. In such a case, outwardly facing edges of such flat bars should be manually aligned by sight with the adjacent sides 34 and 36 of the plate 10 prior to clamping the flat bars against the plate 10 between the jaws 14 and 18. With proper care, an accurate right angle weld joint can thus be obtained between two such flat bars. The backing bars 62 and 63 need not be attached to the plate 10 when securing and welding such flat bars together.

For the arrangement of the members 28 and 30 as shown in FIGS. 7–9, the plate 10 is mounted on the jaw 14 with the apex 38 located between the arms **16*a* and 16*b* near the base of the jaw 14 and pointing toward the handles 22 and 24. This arrangement is used to position the members 28 and 30 in a precise end-to-end alignment with opposing ends forming a suitable butt joint as at 70*a* and 70*b* in FIG. 8. The members 28 and 30 are aligned along the base side 32 of the plate 10 with the jaws 14 and 18 open. When the proper alignment spacing for the joint 70*a* and 70*b* is obtained, the jaws 14 and 18 are closed to tightly secure the members 28 and 30 in position and the side seam 70*a* is welded using the surface 56 as a backing for the weld. To weld the side seam 70*b*, the jaws 14 and 18 are opened and the members 28 and 30, now welded together along the seam 70*a*, are turned 180 degrees horizontally as viewed in FIGS. 8–9 and rotated through a vertical arc counterclockwise, as viewed, about an axis concurrent with their longitudinally extending inside corners. The members 28 and 30 are then placed back against the side 32 so that the seam 70*b* lies upon the plate surface 56. The jaws 14 and 18 are then closed a second time to hold the members 28 and 30 while the side seam 70*b*** is welded.

Figure 10:
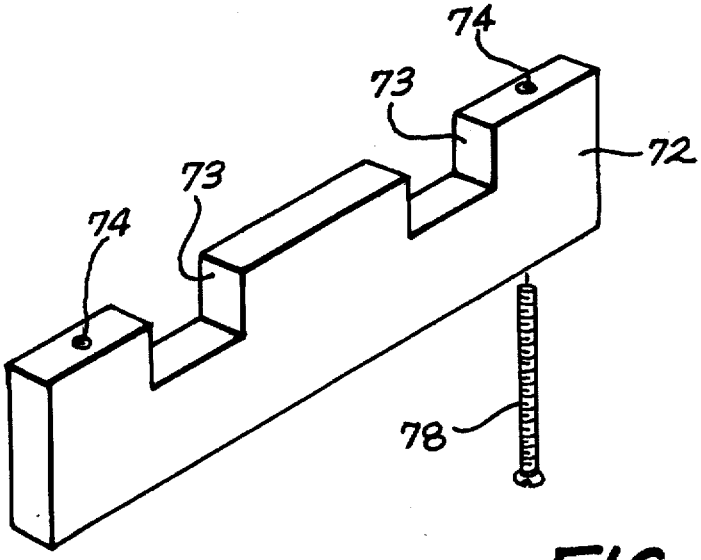
FIG. 10 shows a perspective view of a slotted bar which may be used with the adapter plate of the previous figures as a weld joint backing wall when the plate is arranged as shown in FIGS. 7–9.

In the alternative and to avoid having to interrupt the welding process between the welding of the seams **70*a* and 70*b* to loosen the jaws 14 and 18 so that the members 28 and 30 can be turned around and over for reinsertion into the clamps 12, an elongated weld joint backing bar 72 as shown best in FIG. 10 is connected to the underside 50 of the plate 10 as shown in FIGS. 7–9. The bar 72 is conveniently fastened to the broad surface 50 so as to depend downwardly therefrom as viewed. Like the backing bars 62 and 63, as previously explained, the backing bar 72 should be constructed of a metal suitable for forming a backing for a MIG or arc welded joint such as brass or copper. Its length is not particularly important just so long as it extends fully across the joint 70*b* to be welded and so long as it can be fastened to the plate 10 on both sides of the weld joint 70*b* with suitable spacing therefrom. The bar 72 contains a pair of spaced apart upwardly opening slots 73 in which distal ends of the arms 16*a* and 16*b* may project when the bar 72 is fastened to the plate 10 along the base side 32. The forwardly facing vertical surface of the bar 72 should be precisely aligned with the vertical face of the side 32 when the bar is fastened to the plate 10. The height of the backing bar 72 should be such as to form a backing for the seam 70*b* along its entire length. In the present example, the bar 72 is approximately the same length as the plate side 32, as best seen in FIG. 7. A pair of spaced apart and untapped holes 74 is drilled through the bar 72 from top to bottom so as to register with a pair of tapped blind holes 76 drilled in the plate 10 which open on the broad surface 50. Base portions of the holes 74 are countersunk to accommodate the heads of suitable threaded fasteners 78 which extend upwardly as viewed through the untapped holes 74 in the backing bar 72 and are received and retained in the tapped blind holes 76 of the plate 10**.

In actual practice, I have employed a VISE-GRIP brand set of toggle clamps as the clamps 12 of the present example. The plate 10 used with it is made of brass and has a base side length of 5.25 inches and the adjacent sides are both 3.75 inches in length. The holes 46 are 1.69 inches from the ends of the base side 32 as measured along the base side 32 and are 0.37 inches in from the base side as measured perpendicular thereto. The holes 46 are spaced apart 1.88 inches center to center. The holes 52 near the adjacent sides 34 and 36 are, likewise, 1.88 inches apart, center to center, and are spaced perpendicularly inward from the base side 32 a distance of 1.25 inches. The holes 46 and 52 are large enough in diameter to confine 6–32 screws. The thickness of the plate 10 is ¼ inch. The top and bottom edges of the plate 10 are beveled on approximately a 45 degree angle and have a height along the sides of the plate of approximately 0.12 inches. Using a plate 10 of these dimensions, I found it necessary to grind a 45 degree bevel 80 (FIG. 4 only) on the outer corners of the arms **16*a* and 16*b* of the Vise-Grip lower jaw 14 in order for the adjacent sides 34 and 36 to clear the arms when the plate 10 of the foregoing dimensions was mounted as shown in FIGS. 1 and 3–5**.

It will be appreciated that the angle of the apex 38 is not limited to being a right angle. The apex angle at 38 can be of any other reasonable angle, either above or below 90 degrees, as needed for aligning members such as at 28 and 30 at such other angle. Apex angles less than 90 degrees might be limited in part by the size and shape of the particular set of clamps being used and/or by the amount of bevel grinding required on outer corners of the legs **16*a* and 16*b*. Also, it will be appreciated that other types of clamps and pliers may be usable with the adapter plate of my invention apart from the preferred clamps 12 of the present example. Certainly, the clamps of pliers employed need necessarily not be of the toggle operated type. Further, it will be appreciated that other means of fastening of he adapter plate of my invention to a set of clamps or pliers is within the scope of my invention. For example, where it is only desired to use the plate 10 for positioning workpiece members at right angles relative to one another or, for that matter, at some other predetermined angle relative to one another, the adapter plate can be permanently welded or otherwise permanently affixed to the arms 16*a* and 16*b* of the lower jaw 14 such that the apex 38 points forwardly away from the handles 22 and 24**.

Although the present invention has been explained and illustrated with respect to specific details of a certain preferred embodiment thereof, it is not intended that such details limit the scope of this patent other than as specifically set forth in the following claims.

I claim:

1. In combination with a set of clamps of the type which includes a jaw having a pair of arms which are parallel, spaced apart and which lie essentially in a single plane, a triangularly shaped workpiece positioning adapter plate mounted on said jaw and comprising upper and lower broad flat surfaces, a base side, and a pair of adjacent sides extending from opposite ends of said base side and joining at a predetermined angle to form an apex, said plate being mounted on said jaw with said apex projecting forwardly beyond said jaw between said arms for positioning a pair of angle iron workpieces along and against said adjacent sides for welding said workpieces together opposite said apex.

2. The combination of claim 1 wherein said plate is removably mounted on said jaw, said plate also being mountable on said jaw such that said base side projects forwardly beyond the distal ends of said arms and extends transversely across and in front of said jaw such that a pair of angle iron workpieces can be positioned along and against said base side in a straight end-to-end alignment relative to one another.

3. The combination of claim 1 wherein edges of said plate are beveled to clear elongated rounded inside corners of said angle iron workpieces when said workpieces are positioned against the sides of said plate.

4. The combination of claim 1 wherein said plate is constructed of a material suitable for backing a joint to be welded between two workpieces using a MIG welding process.

5. The combination of claim 1 wherein said plate is constructed of a material suitable for backing a joint to be welded between two workpieces using an arc welding process.

6. The combination of claim 1 further comprising a backing block of rectangular cross-section removably attached to the lower broad surface of said plate and having adjacent vertically extending surfaces which are aligned with the adjacent sides of said plate next to and on both sides of said apex such that a vertically extending edge of said block can be positioned behind a vertically extending gap between opposing ends of said angle iron workpieces.

7. The combination of claim 1 further comprising a backing bar removably attached to said lower broad surface of said plate and extending along and in alignment with the base side of said plate for backing a vertical gap between opposing ends of the pair of angle iron workpieces when said workpieces are aligned along and against said base side.

* * * * *